US009937732B2

(12) United States Patent
Kanemoto

(10) Patent No.: US 9,937,732 B2
(45) Date of Patent: Apr. 10, 2018

(54) MEDIUM TRANSPORT APPARATUS

(71) Applicant: SEIKO EPSON CORPORATION, Tokyo (JP)

(72) Inventor: Shuichi Kanemoto, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/335,232

(22) Filed: Oct. 26, 2016

(65) Prior Publication Data

US 2017/0120627 A1 May 4, 2017

(30) Foreign Application Priority Data

Oct. 29, 2015 (JP) ..... 2015-212683

(51) Int. Cl.
*B41J 11/00* (2006.01)

(52) U.S. Cl.
CPC ..... *B41J 11/0005* (2013.01)

(58) Field of Classification Search
CPC ..... B41J 11/0005
See application file for complete search history.

(56) References Cited

U.S. PATENT DOCUMENTS 5,787,331 A * 7/1998 Ohkuma ..... B41J 3/60 162/271
2015/0210497 A1 7/2015 Zhou
2015/0239263 A1* 8/2015 Ishizuka ..... B41J 3/4078 347/16

FOREIGN PATENT DOCUMENTS

| | | |
|---|---|---|
| DE | 33 01 989 A1 | 8/1984 |
| JP | 04-028653 | 1/1992 |
| JP | 2002-249976 | 9/2002 |
| JP | 2002 249976 A | 9/2002 |
| JP | 2013-019083 | 1/2013 |

OTHER PUBLICATIONS

European Search Report for Application No. 16193580.4 dated Apr. 4, 2017.

* cited by examiner

*Primary Examiner* — Alessandro Amari
*Assistant Examiner* — Roger W Pisha, II
(74) *Attorney, Agent, or Firm* — Workman Nydegger

(57) ABSTRACT

A medium transport apparatus includes a transport section configured to support a medium and transport the medium in a transport direction, and a wrinkle reducing section configured to come into contact with the medium to reduce the formation of wrinkles in the medium. The wrinkle reducing section can change surfaces to come into contact with the medium. The medium transport apparatus having such a structure enables to reduce the formation of wrinkles in the medium.

10 Claims, 13 Drawing Sheets

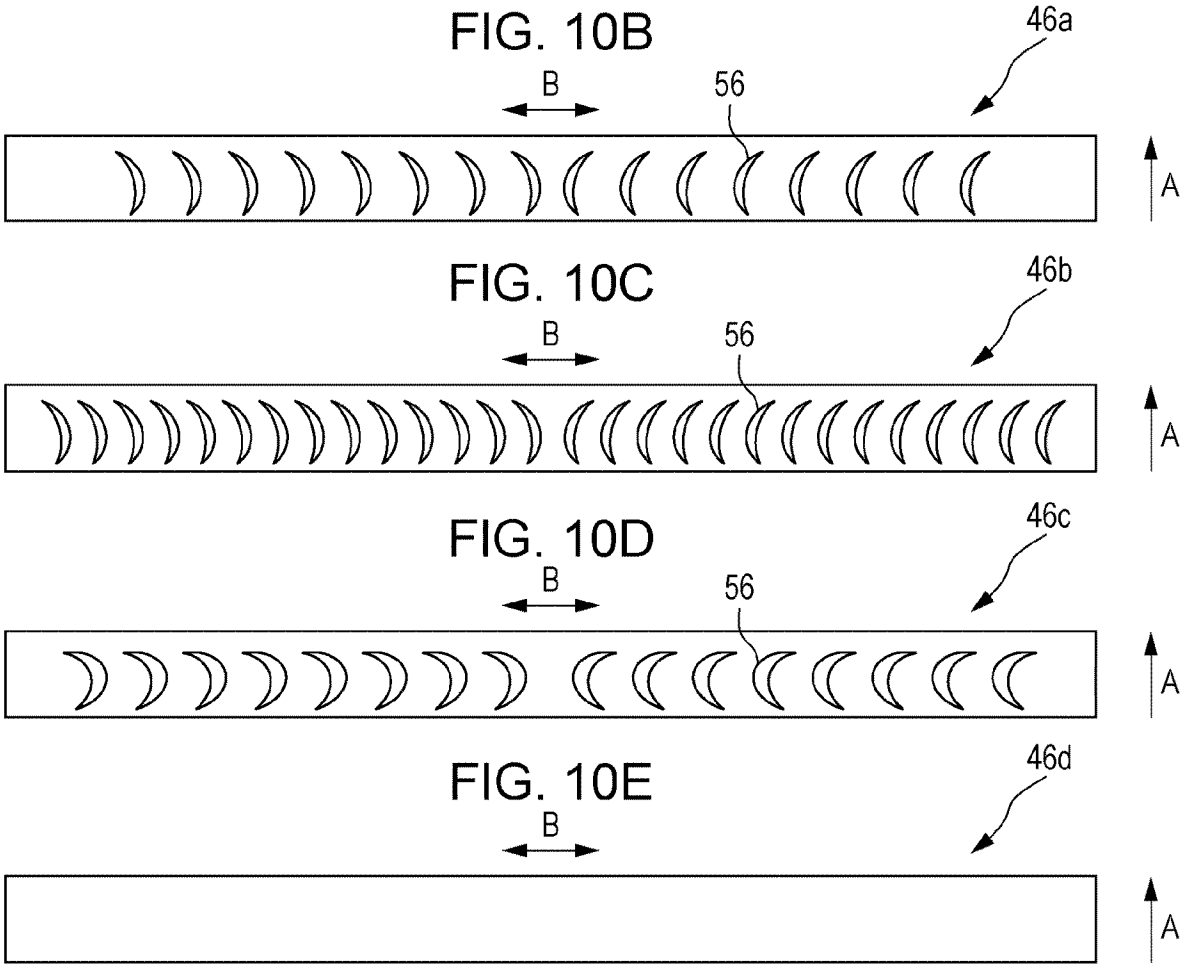
FIG. 10B
FIG. 10C
FIG. 10D
FIG. 10E
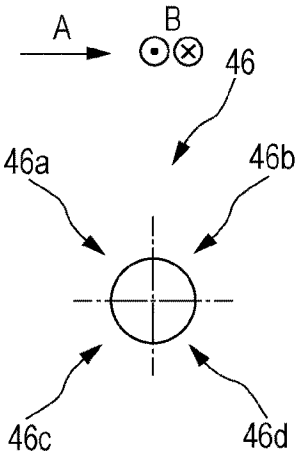
FIG. 10A

MEDIUM TRANSPORT APPARATUS

BACKGROUND

1. Technical Field

The present invention relates to a medium transport apparatus.

2. Related Art

Typical disclosed medium transport apparatuses include recording apparatuses that transport a medium (recording medium) and discharge ink onto the transported medium for recording. Among such medium transport apparatuses, many medium transport apparatuses are provided with components for reducing the formation of wrinkles to prevent the formation of wrinkles in the transported medium. For example, JP-A-2013-19083, JP-A-2002-249976, and JP-A-4-28653 disclose medium transport apparatuses that include wrinkle removing rollers, wrinkle flattening mechanisms, and the like as the components for reducing the formation of wrinkles in a medium.

Such medium transport apparatuses use various media made of different materials and have different thicknesses, and in some cases, it is difficult to appropriately prevent the formation of wrinkles in the media by the structures disclosed in the patent documents.

SUMMARY

An advantage of some aspect of the invention is that the formation of wrinkles in a medium can be reduced.

A medium transport apparatus according to a first aspect of the invention for solving the above-mentioned problem includes a transport section configured to support a medium and transport the medium in a transport direction, and a wrinkle reducing section configured to come into contact with the medium to reduce the formation of wrinkles in the medium. The wrinkle reducing section can change surfaces to come into contact with the medium.

According to this aspect, the wrinkle reducing section configured to come into contact with the medium to reduce the formation of wrinkles in the medium is provided, and the wrinkle reducing section can change surfaces to come into contact with the medium. For example, as the wrinkle reducing section, a tension applying section that can come into contact with a medium and apply a tension to the medium in a direction which intersects the transport direction (can smooth wrinkles in the direction which intersects the transport direction) can be provided, and the tension applying section can change the surfaces to come into contact with the medium. Accordingly, the surface to come into contact with the medium can be changed depending on the medium to be used, and thereby the formation of wrinkles in the medium can be effectively reduced. Here, "to reduce the formation of wrinkles" includes simply to prevent the formation of wrinkles, and also may include to remove formed wrinkles. The structure which "can apply a tension in a direction which intersects the transport direction" can be any structure capable of applying a tension (force for pulling the medium outward) in the direction which intersects the transport direction (capable of smoothing wrinkles in the direction which intersects the transport direction) by using at least one of the contact surfaces.

In the medium transport apparatus according to a second aspect of the invention, in the first aspect, the wrinkle reducing section has a plurality of surfaces of different surface characteristics as the contact surfaces.

According to this aspect, the wrinkle reducing section has the plurality of surfaces of different surface characteristics as the contact surfaces. This structure enables to reduce the increase in the number of components and reduce the formation of wrinkles in the medium.

In the medium transport apparatus according to a third aspect of the invention, in the second aspect, the wrinkle reducing section includes a roller having surfaces of different surface characteristics.

According to this aspect, the wrinkle reducing section includes the roller having surfaces of different surface characteristics. This simple structure enables to reduce the increase in the number of components and reduce the formation of wrinkles in the medium. The "roller" has a circular cross section, or may have an elliptical cross section, or a polygonal cross section.

In the medium transport apparatus according to a fourth aspect of the invention, in the first aspect, the wrinkle reducing section has a plurality of surfaces of different contact areas as the contact surfaces.

According to this aspect, the wrinkle reducing section has the plurality of surfaces of different contact areas as the contact surfaces. Accordingly, the formation of wrinkles in the medium can be reduced by the surfaces of different contact areas, and thereby the structure of each surface can be simplified.

In the medium transport apparatus according to a fifth aspect of the invention, in the fourth aspect, the wrinkle reducing section includes a plurality of rollers of different outer diameters.

According to this aspect, the wrinkle reducing section includes the plurality of rollers of different outer diameters. Accordingly, the formation of wrinkles in the medium can be reduced by the rollers having the respective surfaces of simple structures.

The medium transport apparatus according to a sixth aspect of the invention includes, in the first aspect, a tension adjusting mechanism provided between the wrinkle reducing section and the transport section, and the tension adjusting mechanism is capable of applying a predetermined tension to the medium in the transport direction.

According to this aspect, the tension adjusting mechanism capable of applying a predetermined tension to the medium in the transport direction is provided. That is, the medium can be supported on the transport section in a state a predetermined tension (tension appropriate for the medium type) is being applied in the transport direction. Accordingly, the formation of wrinkles in the medium can be specifically effectively reduced.

The medium transport apparatus according to a seventh aspect of the invention includes, in the first aspect, a supplying section configured to supply the medium to the transport section. The wrinkle reducing section is provided between the supplying section and the transport section.

According to this aspect, the supplying section configured to supply the medium to the transport section is provided, and the wrinkle reducing section is provided between the supplying section and the transport section. Accordingly, the formation of wrinkles during the supply of the medium from the supplying section to the transport section can be effectively reduced.

The medium transport apparatus according to an eighth aspect includes, in the seventh aspect, a pressing section configured to press the medium supplied from the supplying section against the transport section. The wrinkle reducing section is provided between the supplying section and the pressing section.

According to this aspect, the medium can be appropriately supported on the transport section by the pressing section, and the formation of wrinkles during the supply of the medium from the supplying section to the transport section can be specifically effectively reduced by the wrinkle reducing section provided between the supplying section and the pressing section.

The medium transport apparatus according to a ninth aspect of the invention includes, in the first aspect, a winding section configured to wind the medium transported by the transport section, and the wrinkle reducing section is provided between the transport section and the winding section.

According to this aspect, the winding section configured to wind the medium transported by the transport section is provided, and the wrinkle reducing section is provided between the transport section and the winding section. Accordingly, the formation of wrinkles during the winding operation by the winding section can be specifically effectively reduced.

In the medium transport apparatus according to a tenth aspect of the invention, in the first aspect, the wrinkle reducing section includes a metallic member.

According to this aspect, the wrinkle reducing section includes the metallic member, and through the wrinkle reducing section, the buildup of static electricity on the medium can be released.

According to an eleventh aspect of the invention, the wrinkle reducing section includes a resin member.

According to this aspect, the wrinkle reducing section includes the resin member, and thereby the weight of the wrinkle reducing section can be reduced, and the replacement of the wrinkle reducing sections can be facilitated.

BRIEF DESCRIPTION OF THE DRAWINGS

The invention will be described with reference to the accompanying drawings, wherein like numbers reference like elements.

FIGS. 10A to 10E are schematic diagrams of the main components of the recording apparatus according to the embodiment of the invention.

DESCRIPTION OF EXEMPLARY EMBODIMENTS

Figure 1:
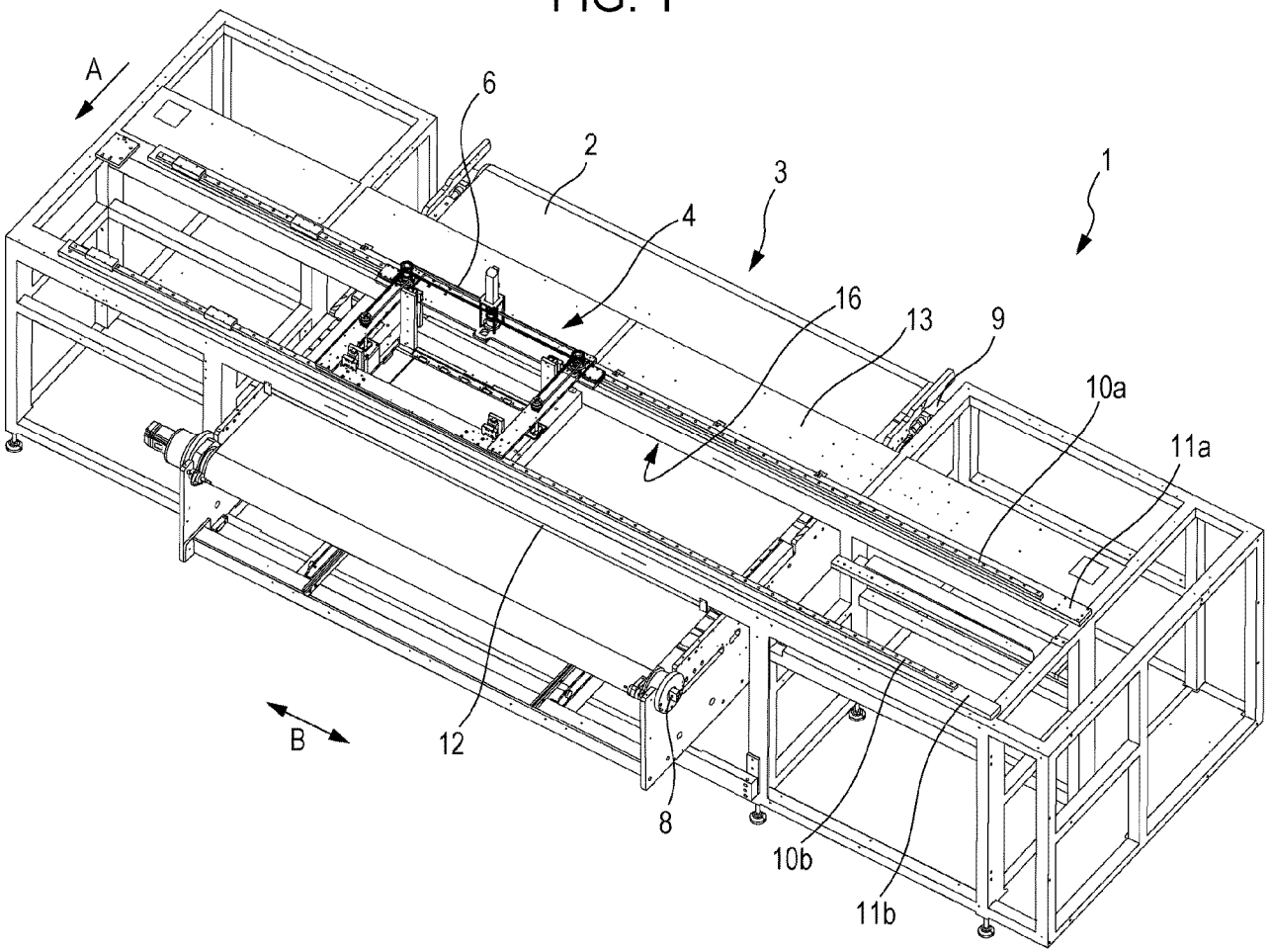
FIG. 1 is a schematic perspective view of a recording apparatus according to an embodiment of the invention.
Figure 2:
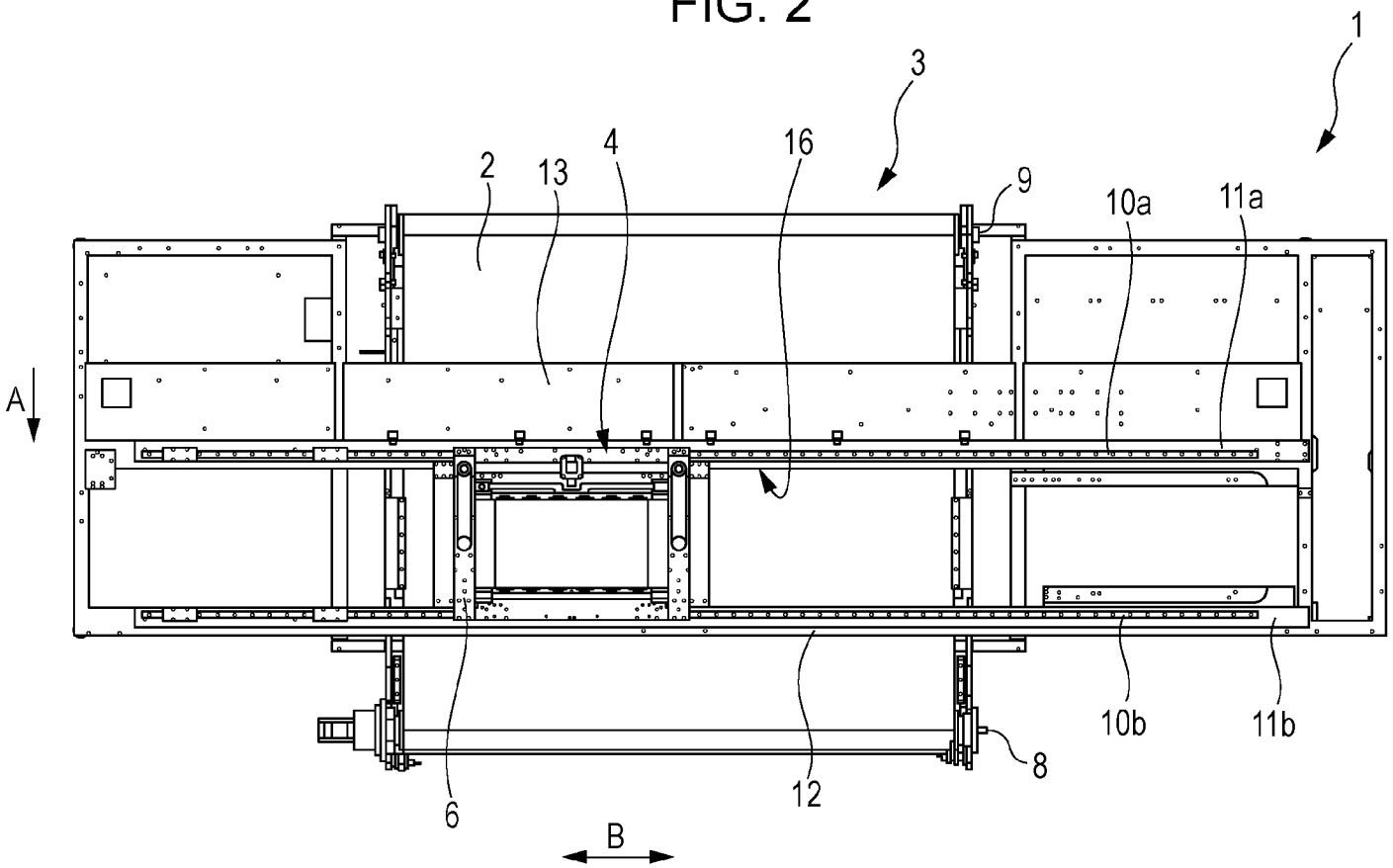
FIG. 2 is a schematic plan view of the recording apparatus according to the embodiment of the invention.
Figure 3:
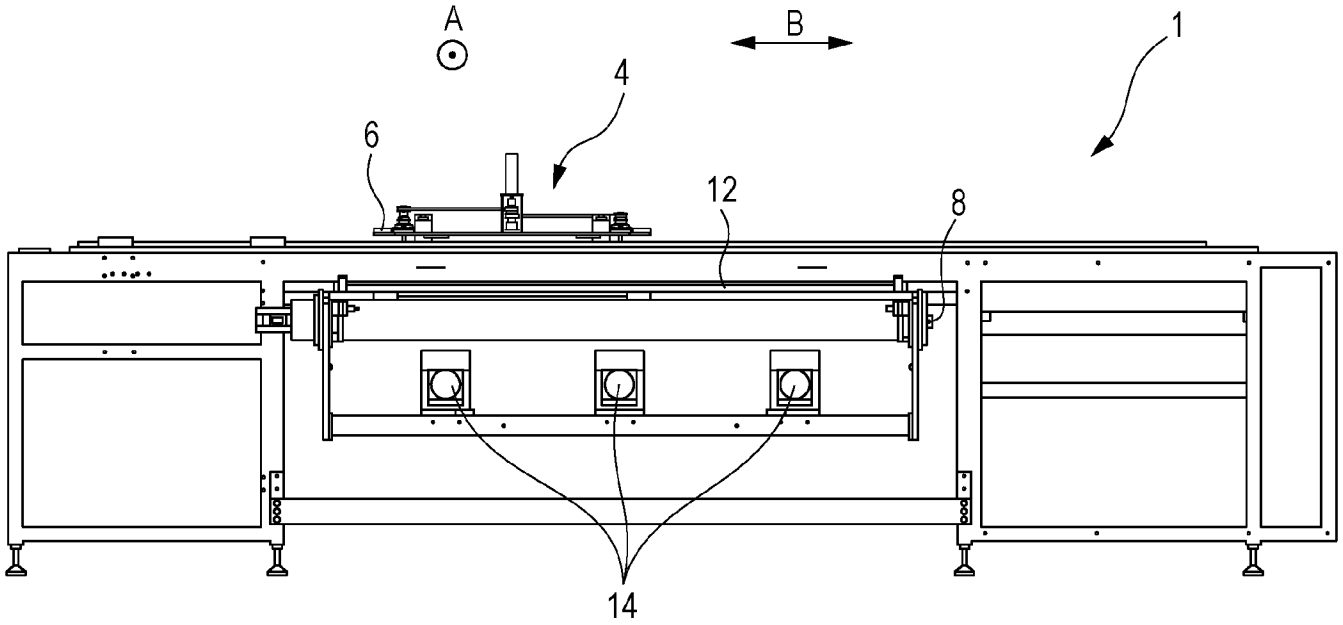
FIG. 3 is a schematic front view of the recording apparatus according to the embodiment of the invention.
Figure 4:
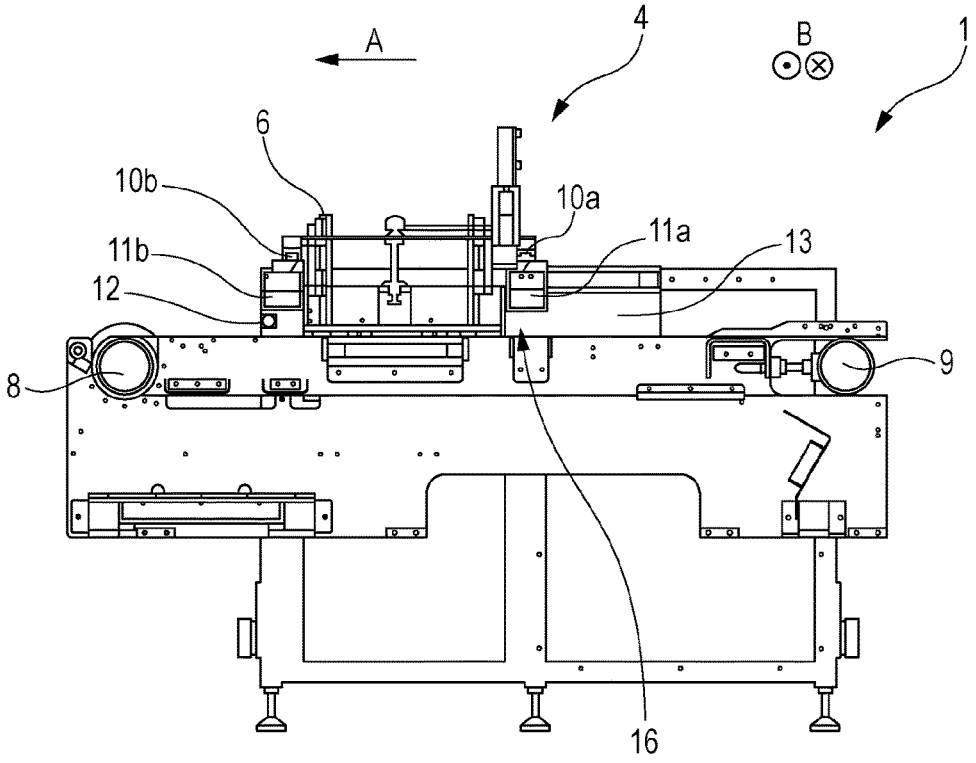
FIG. 4 is a schematic side view of the recording apparatus according to the embodiment of the invention.
Figure 5:
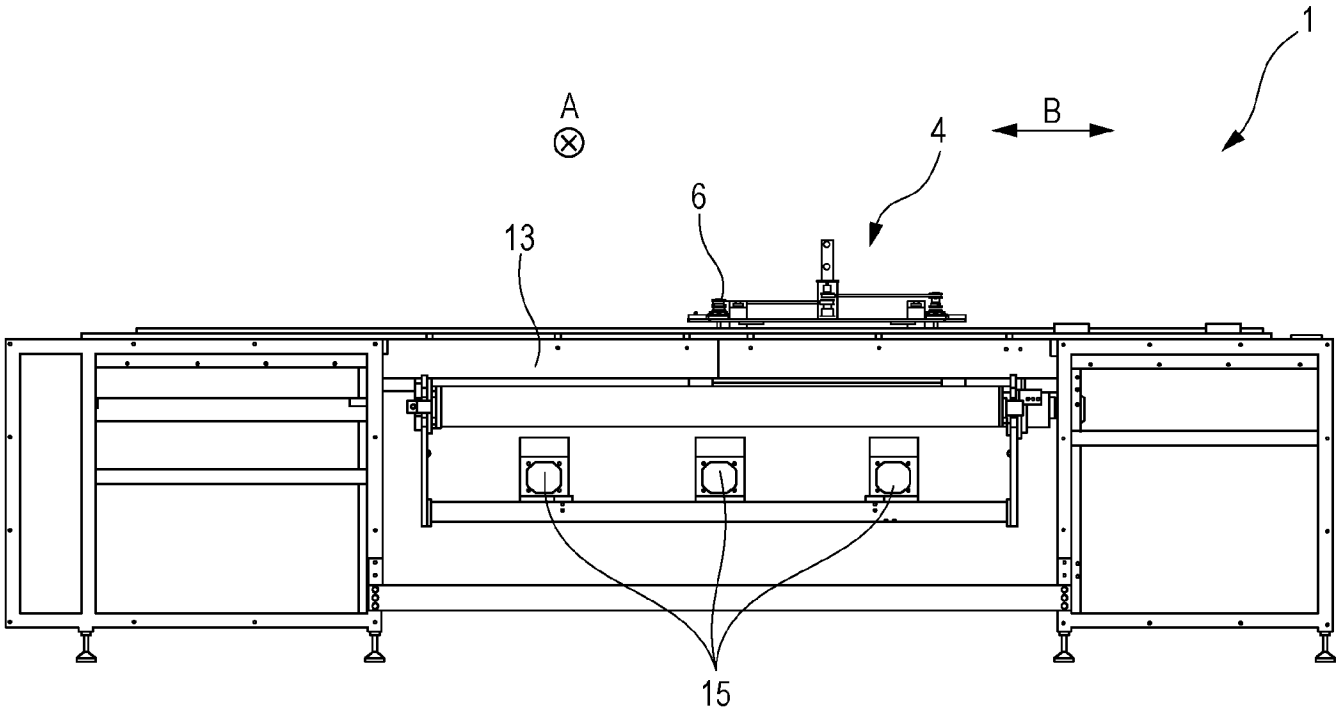
FIG. 5 is a schematic rear view of the recording apparatus according to the embodiment of the invention.

Hereinafter, a recording apparatus according to an embodiment of a medium transport apparatus of the invention will be described in detail with reference to the attached drawings. First, a recording apparatus 1 according to the embodiment of the invention is briefly described. FIG. 1 is a schematic perspective view of the recording apparatus 1 according to the embodiment. FIG. 2 is a schematic plan view of the recording apparatus 1 according to the embodiment. FIG. 3 is a schematic front view of the recording apparatus 1 according to the embodiment. FIG. 4 is a schematic side view of the recording apparatus 1 according to the embodiment. FIG. 5 is a schematic rear view of the recording apparatus 1 according to the embodiment. The recording apparatus 1 according to the embodiment from which some components are removed is shown in FIGS. 1 to 5, for example, a feeding section 40 (see FIG. 6 and FIG. 7) for feeding a medium, which will be described below, is removed, and a recording head 7 (see FIG. 8) is removed from a carriage 6.

The recording apparatus 1 according to the embodiment includes a transport mechanism 3 that transports a recording medium (medium) M in a transport direction A with an adhesive belt (endless belt) 2 that supports the recording medium M on its support surface where an adhesive has been applied. To the recording apparatus 1 according to the embodiment, a roll R (see FIG. 6 and FIG. 7) of the recording medium M can be set, and the recording apparatus 1 includes the feeding section 40 that can feed the recording medium M toward the transport mechanism 3 (these components will be described in detail below). The recording apparatus 1 also includes a recording mechanism 4 that reciprocates the carriage 6 having the recording head 7 for discharging an ink in reciprocating moving directions B, which intersect the transport direction A of the recording medium M, for recording within the transport area of the recording medium M transported by the transport mechanism 3. The recording apparatus 1 also includes a winding mechanism (not shown) that can wind the recording medium M on which the recording has been performed by the recording mechanism 4.

The transport mechanism 3 according to the embodiment includes the adhesive belt 2 that serves as a transport section for mounting and transporting the recording medium M fed from the feeding section 40, a driving roller 8 that moves the adhesive belt 2, and a driven roller 9. The recording medium M adheres to the support surface of the adhesive belt 2 and is mounted thereon. The endless belt that serves as the transport belt is not limited to the adhesive belt. For example, an electrostatic attraction type endless belt may be used.

The recording mechanism 4 includes a carriage motor 30 (see FIG. 8) that reciprocates the carriage 6 including the recording head 7 capable of discharging an ink (liquid) in the reciprocating moving directions B. The recording apparatus 1 according to the embodiment reciprocates the carriage 6 including the recording head 7 for recording during a recording operation, in contrast, the transport mechanism 3 stops the transport of the recording medium M during the recording operation (while the carriage 6 is moving). In other words, during the recording operation, the recording apparatus 1 alternately performs the reciprocating operation of the carriage 6 and the transporting operation of the recording medium M. Accordingly, the transport mechanism 3 intermittently transports the recording medium M (intermittently moves the adhesive belt 2) in response to the reciprocating operation of the carriage 6 during the recording operation.

A pipe 11*a* that is a part of the structural frame of the recording apparatus 1 according to the embodiment is provided with a rail 10*a* that extends in the reciprocating moving direction B, and the pipe 11*b* that is a part of the structural frame of the recording apparatus 1 according to the embodiment is provided with a rail 10*b* that extends in the reciprocating moving direction B. The carriage 6 according to the embodiment is guided by the rail 10*a* and the rail 10*b* with bearing portions (not shown) provided on the rail 10*a* and the rail 10*b* during a moving operation in the reciprocating moving directions B.

An air blower section 12 is provided below the pipe 11*b*. The air blower section 12 extends in the reciprocating moving direction B and blows air in the direction opposite to the transport direction A from a plurality of air blower ports (not shown). A mist collecting portion 13 is provided below the pipe 11*a*. The mist collecting portion 13 extends in the reciprocating moving direction B and can collect a mist of ink discharged from the recording head 7. The mist collecting portion 13 includes a collecting port 16 that is provided below the pipe 11*a* and extends in the reciprocating moving direction B. A plurality of (three) air blower fans 14 for producing winds to be sent by the air blower section 12 are provided on the downstream side in the transport direction A in the recording apparatus 1 according to the embodiment, as shown in FIG. 3. By the winds produced by the air blower fans 14, the air blower section 12 can send the winds from the outside (the position on the downstream side in the transport direction A) of the collecting section 13 toward the collecting port 16. A plurality of (three) suction fans 15 that produce air currents from the collecting port 16 toward the inside of the collecting section 13, and further from the inside of the collecting section 13 toward the outside of the recording apparatus 1, and serves as a suction section, are provided on the upstream side in the transport direction A in the recording apparatus 1 according to the embodiment, as shown in FIG. 5. The transport direction A refers to the direction the recording medium M proceeds on the transport path of the recording medium M. The upstream side and the downstream side in the transport direction A refer to the upstream side and the downstream side with respect to the direction the recording medium M proceeds on the transport path of the recording medium M.

Figure 6:
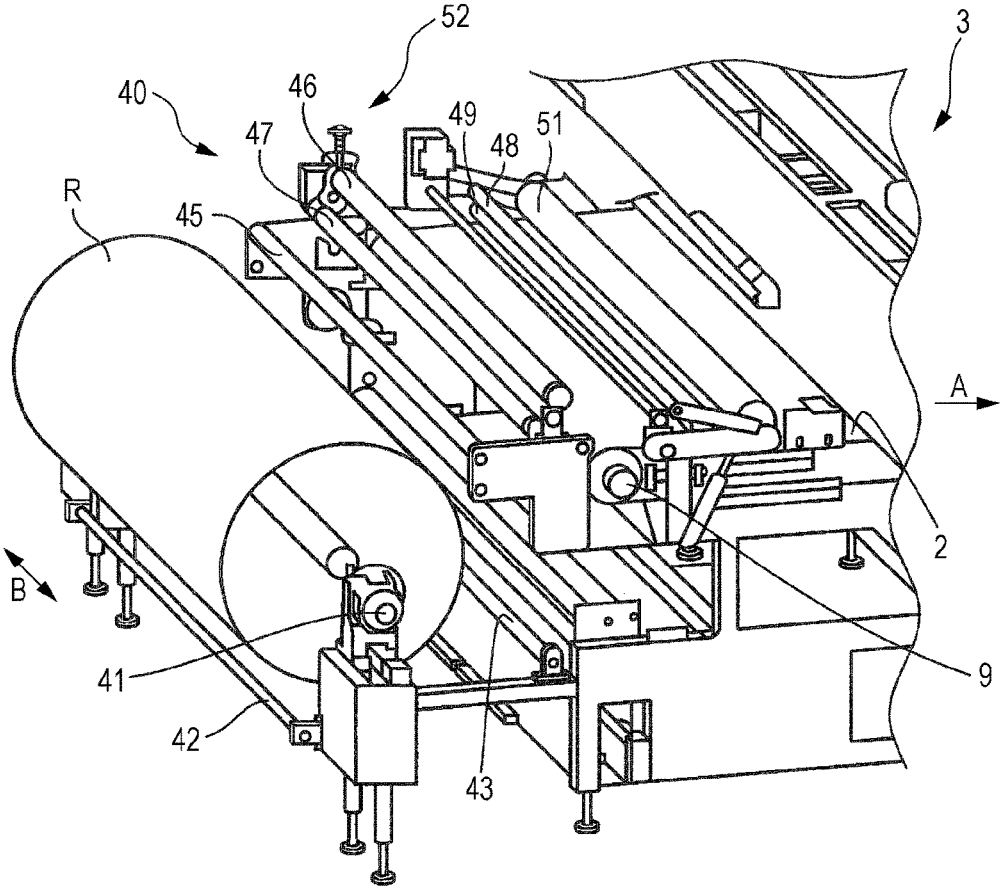
FIG. 6 is a schematic perspective view of main components of the recording apparatus according to the embodiment of the invention.
Figure 7:
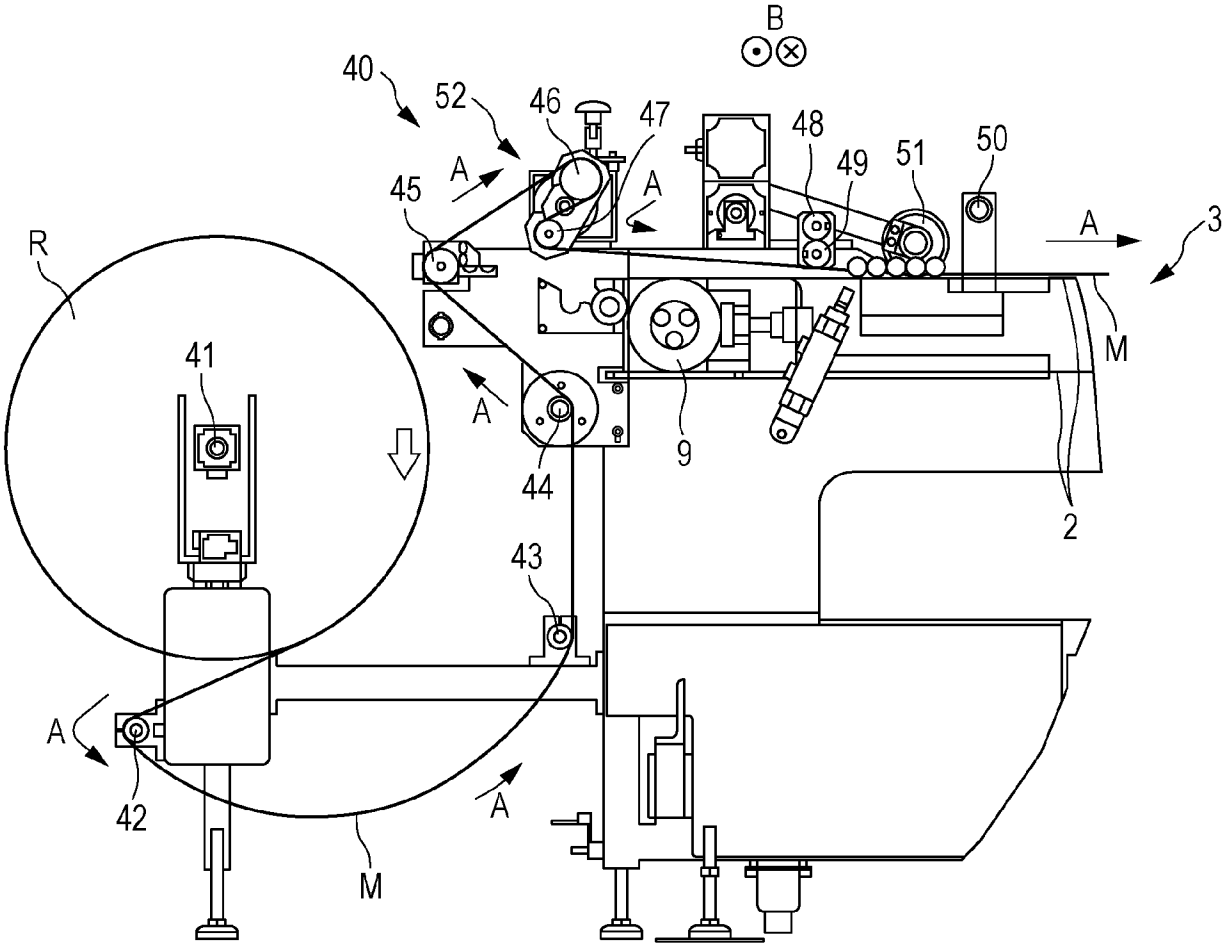
FIG. 7 is a schematic side view of the main components of the recording apparatus according to the embodiment of the invention.

Next, the feeding section 40, which is a main component of the recording apparatus 1 according to the embodiment, will be described. FIG. 6 is a schematic perspective view of the feeding section 40, and FIG. 7 is a schematic side view of the feeding section 40. FIG. 6 shows that the roll R of the recording medium M has been set to a setting section 41, and FIG. 7 shows that the recording medium M is being supplied to the transport mechanism 3. To facilitate the understanding of the structure of the feeding section 40, both FIG. 6 and FIG. 7 show the roll R of the recording medium M in the perspective views.

The feeding section 40 according to the embodiment includes rollers 42, 43, 44, 45, 46, 47, 48, 49, 50, and 51 on the transport path of the recording medium M. Among them, the rollers 46 and 47 are wrinkle removing rollers that form a tension applying unit 52, which serves as a wrinkle reducing section, and will be described in detail below. The roller 51 is a pressure roller for pressing the recording medium M against the adhesive belt 2 to appropriately support the recording medium M. In FIG. 7, the recording medium M is supplied from the roll R, which has been set to the setting section 41, to the adhesive belt 2 via the rollers 42, 43, 44, 45, 46, 47, 49, and 51. In addition to the above-described supply path (transport path), the feeding section 40 according to the embodiment can supply the recording medium M from the roll R, which has been set to the setting section 41, to the adhesive belt 2, for example, by using only the rollers 45, 46, 47, 49, and 51 without using the rollers 42, 43, and 44. That is, the feeding section 40 can supply the recording medium M from the roll R, which has been set to the setting section 41, to the adhesive belt 2 via a plurality of supply paths (transport paths). In other words, the setting section 41 serves as a supplying section for supplying the recording medium M to the transport section, and the feeding section 40 can supply the recording medium M to the transport section via a plurality of supply paths.

Figure 8:
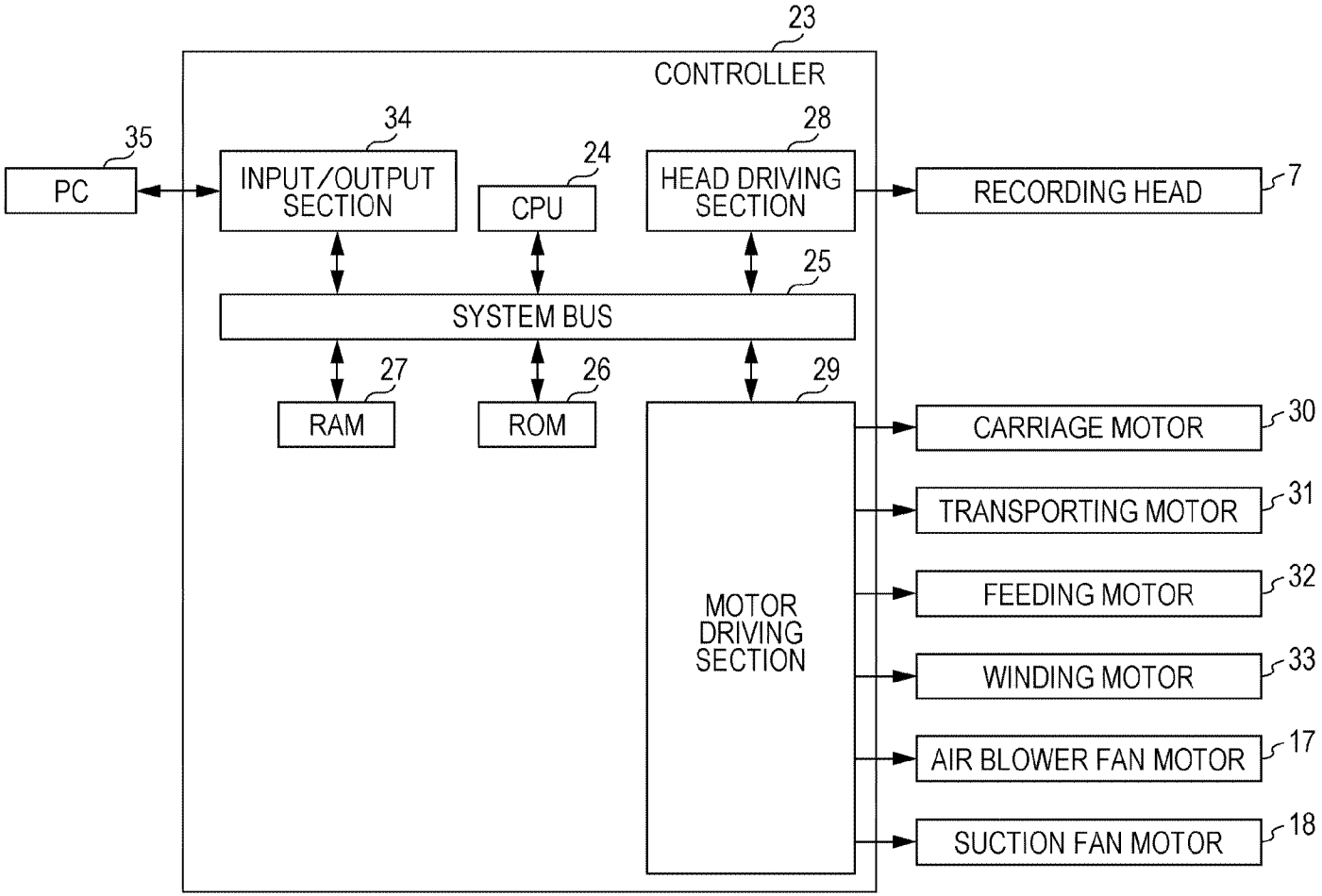
FIG. 8 is a block diagram of the recording apparatus according to the embodiment of the invention.

Next, an electric configuration in the recording apparatus 1 according to the embodiment will be described. FIG. 8 is a block diagram of the recording apparatus 1 according to the embodiment. A controller 23 includes a central processing unit (CPU) 24 that performs overall control of the recording apparatus 1. The CPU 24 is connected to a read-only memory (ROM) 26 that stores various control programs to be executed by the CPU 24 and a random access memory (RAM) 27 that can temporarily store data via a system bus 25.

The CPU 24 is also connected to a head driving section 28 for driving the recording head 7 via the system bus 25. The CPU 24 is also connected to a motor driving section 29 for driving a carriage motor 30, a transporting motor 31, a feeding motor 32, a winding motor 33, an air blower fan motor 17, and a suction fan motor 18. The carriage motor 30 is used to move the carriage 6 that includes the recording head 7. The transporting motor 31 is used to drive the driving roller 8. The feeding motor 32 is a driving motor for the setting section 41 that sends the recording medium M that has been set to the setting section 41 toward the transport mechanism 3. The winding motor 33 is a driving motor for driving a winding mechanism (not shown) to wind the recording medium M on which recording has been performed. The air blower fan motor 17 is used to drive the air blower fans 14. The suction fan motor 18 is used to drive the suction fans 15. Furthermore, the CPU 24 is also connected to an input/output section 34 via the system bus 25. The input/output section 34 is connected to a personal computer (PC) 35 that is used to send and receive data such as recording data and signals.

Figure 9:
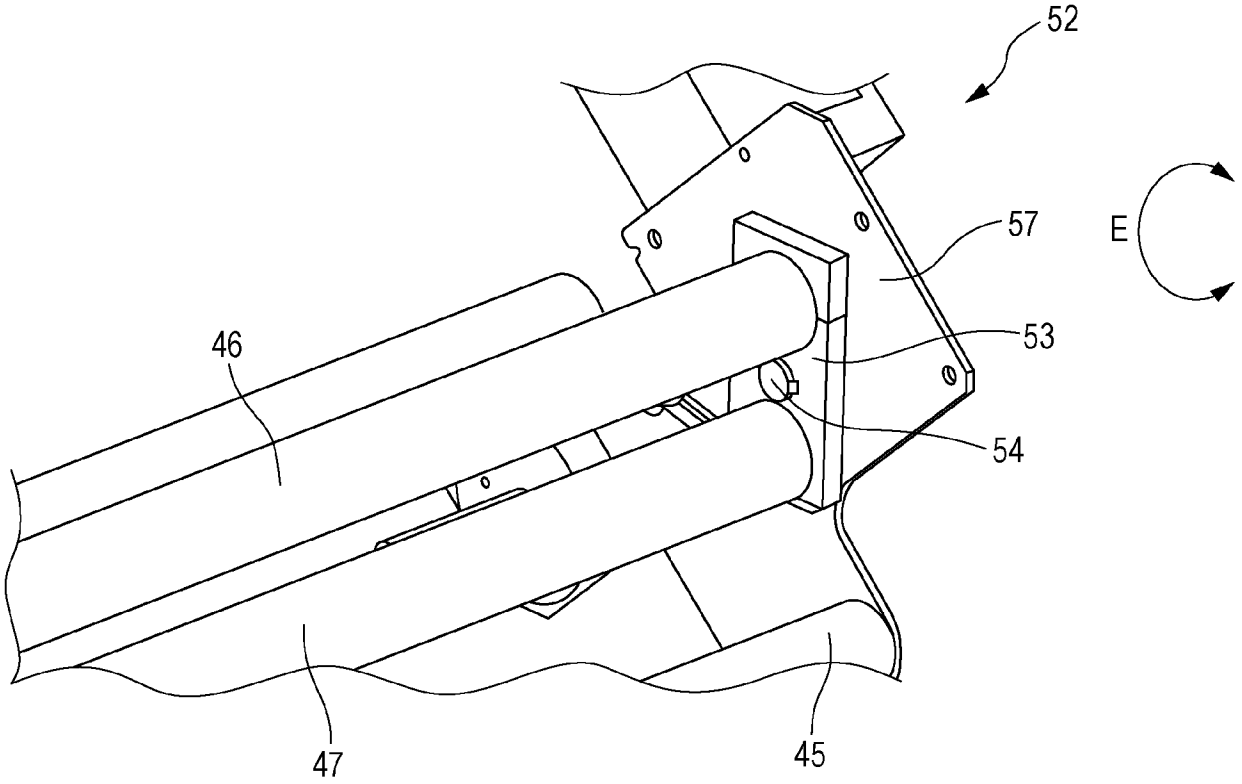
FIG. 9 is a schematic perspective view of the main components of the recording apparatus according to the embodiment of the invention.

The tension applying unit 52 in the feeding section 40 that is a main component according to the embodiment will be described. The tension applying unit 52 according to the embodiment comes in contact with the recording medium M to apply a tension in a direction (direction along the reciprocating moving direction B) that intersects the transport direction A to reduce wrinkles in the recording medium M. FIG. 9 is a schematic perspective view of the tension applying unit 52 according to the embodiment. FIGS. 10A to 10 E are schematic diagrams of the wrinkle removing roller 46 that is included in the tension applying unit 52.

The tension applying unit 52 according to the embodiment includes the wrinkle removing rollers 46 and 47 that come in contact with the recording medium M, as shown in FIG. 9. The wrinkle removing rollers 46 and 47 have similar structures except that the outer diameters (diameters) of the wrinkle removing rollers 46 and 47 are different (the wrinkle removing roller 46 is larger). The wrinkle removing rollers 46 and 47 are attached to a rotating plate 53, which can rotate about a rotation shaft 54 in rotation directions E with respect to a base section 57, with a screw. The positions of the wrinkle removing rollers 46 and 47 can be changed by turning the screw such that the wrinkle removing rollers 46 and 47 rotate in the rotation directions E with respect to the rotating plate 53. The above-described structure enables, when the recording medium M is fed from the feeding section 40 to the transport mechanism 3, to adjust the tension (to adjust the angle of the base section 57) in the transport direction A applied to the recording medium M, to adjust the surfaces (for example, to change the surface to a surface 46*a*, a surface 46*b*, a surface 46*c*, or a surface 46*d*, which will be described below) of the wrinkle removing rollers 46 and 47 to come into contact with the recording medium M, and to adjust the contact area (to change to bring one of (or both) the wrinkle removing rollers 46 and 47 into contact with the recording medium M) to be brought into contact with the recording medium M.

Hereinafter, the wrinkle removing roller 46 will be described in detail. FIG. 10A is a schematic structural view of the wrinkle removing roller 46 viewed from the side surface direction. FIG. 10B, FIG. 10C, FIG. 10D, and FIG. 10E show surfaces of the wrinkle removing roller 46 split into four. FIG. 10B shows the surface 46*a* of the wrinkle removing roller 46. FIG. 10C shows the surface 46*b* of the wrinkle removing roller 46. FIG. 10D shows the surface 46*c* of the wrinkle removing roller 46. FIG. 10E shows the surface 46*d* of the wrinkle removing roller 46. Grooves 56 are formed on the surface 46*a* such that the grooves 56 are positioned outward as the grooves proceed in the transport direction A, as shown in FIG. 10B. The grooves 56 are formed on the surface 46*b* such that the grooves 56 are positioned outward as the grooves proceed in the transport direction A, as shown in FIG. 10C. The spaces between the grooves 56 are narrower than the spaces on the surface 46*a*. The grooves 56 are formed on the surface 46*c* such that the grooves 56 are positioned outward as the grooves proceed in the transport direction A, as shown in FIG. 10D. The width of the grooves 56 is wider than that on the surface 46*a*. No grooves 56 are formed on the surface 46*d*, and a smooth arc-shaped surface is provided, as shown in FIG. 10E. The wrinkle removing roller 47 according to the embodiment has a structure similar to that of the wrinkle removing roller 46 except that the diameter of the wrinkle removing roller 47 is smaller than that of the wrinkle removing roller 46, however, the structure is not limited to this example. For example, the whole surface of the wrinkle removing roller 47 may be a smooth arc-shaped surface.

Figure 11A:
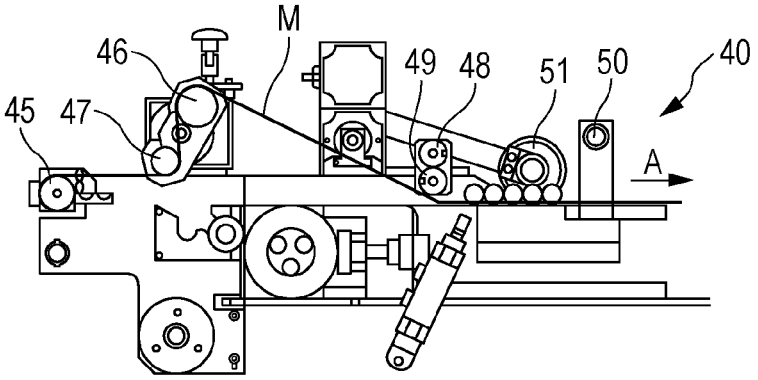
FIGS. 11A to 11F are schematic side views of the main components of the recording apparatus according to the embodiment of the invention.
Figure 11B:
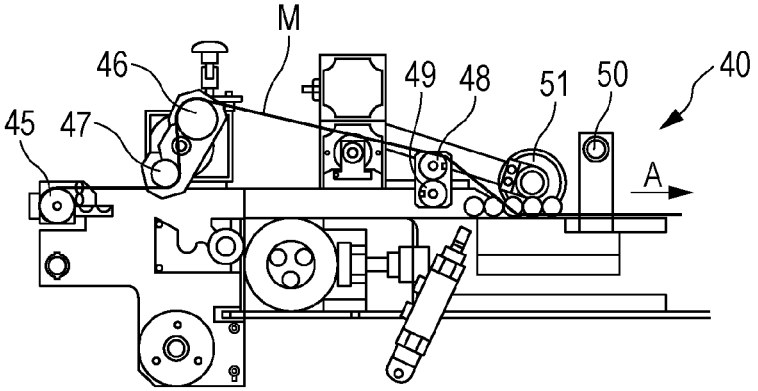
Figure 11C:
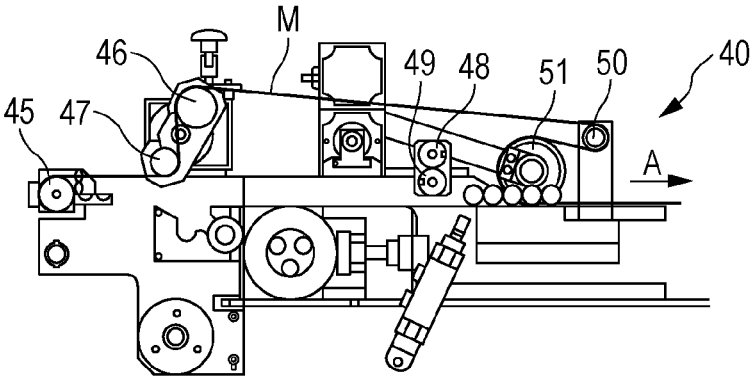
Figure 11D:
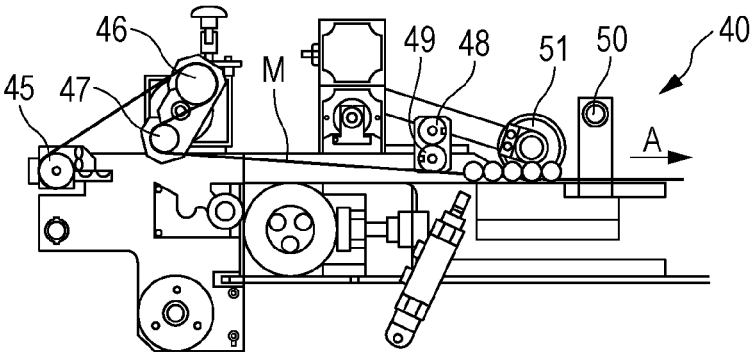
Figure 11E:
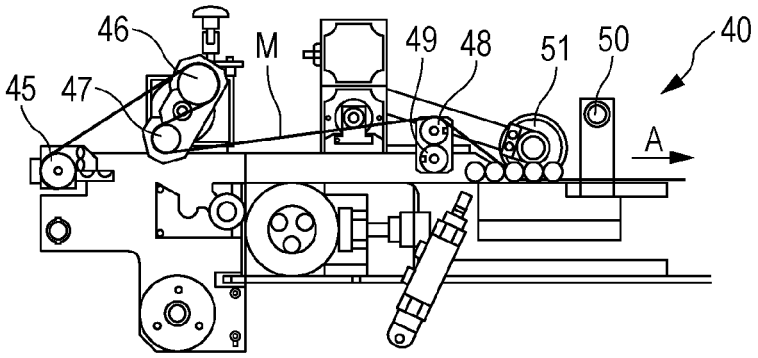
Figure 11F:
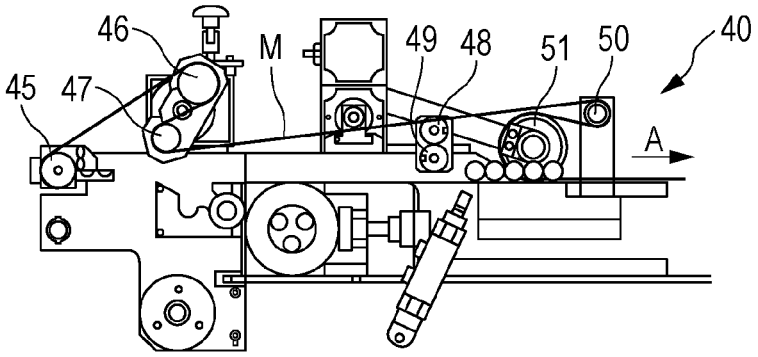

Now, example transport paths of the recording medium M in the feeding section 40, which is a main component according to the embodiment, will be described. FIGS. 11A to 11F are schematic side views of the feeding section 40 according to the embodiment. Among them, FIG. 11A, FIG. 11B, and FIG. 11C show examples in which the wrinkle removing roller 46 and the wrinkle removing roller 47 are used as the wrinkle removing rollers, and the wrinkle removing roller 46 is used as a main roller (a roller close to the pressure roller 51). In contrast, FIG. 11D, FIG. 11E, and FIG. 11F show examples in which the wrinkle removing roller 46 and the wrinkle removing roller 47 are used as the wrinkle removing rollers, and the wrinkle removing roller 47 is used as a main roller (a roller close to the pressure roller 51). As shown in FIG. 11A, the feeding section 40 according to the embodiment can transport (supply) the recording medium M by bringing the rollers 45, 47, 46, 49, and 51 into contact with the recording medium M in this order. As shown in FIG. 11B, the feeding section 40 according to the embodiment can transport (supply) the recording medium M by bringing the rollers 45, 47, 46, 48, and 51 into contact with the recording medium M in this order. As shown in FIG. 11C, the feeding section 40 according to the embodiment can transport (supply) the recording medium M by bringing the rollers 45, 47, 46, 50, and 51 into contact with the recording medium M in this order. As shown in FIG. 11D, the feeding section 40 according to the embodiment can transport (supply) the recording medium M by bringing the rollers 45, 46, 47, 49, and 51 into contact with the recording medium M in this order. As shown in FIG. 11E, the feeding section 40 according to the embodiment can transport (supply) the recording medium M by bringing the rollers 45, 46, 47, 48, and 51 into contact with the recording medium M in this order. As shown in FIG. 11F, the feeding section 40 according to the embodiment can transport (supply) the recording medium M by bringing the rollers 45, 46, 47, 50, and 51 into contact with the recording medium M in this order.

In summary, the recording apparatus 1 according to the embodiment includes the adhesive belt 2 that supports the recording medium M and transports the recording medium M in the transport direction A, and the tension applying unit 52 that can come into contact with the recording medium M and apply a tension to the recording medium M in the direction which intersects the transport direction A (can smooth wrinkles in the direction which intersects the transport direction A), as the wrinkle reducing section for reducing the formation of wrinkles in the recording medium M. The tension applying unit 52 can change the surfaces to come into contact with the recording medium M among the surface 46*a*, the surface 46*b*, the surface 46*c*, and the surface 46*d* of the wrinkle removing roller 46, and besides, the surface of the wrinkle removing roller 47. Accordingly, the surface to come into contact with the recording medium M can be changed depending on the recording medium M to be used, and thereby the formation of wrinkles in the recording medium M can be effectively reduced. Here, "to reduce the formation of wrinkles" includes simply to prevent the formation of wrinkles, and may also include to remove formed wrinkles. For example, the wrinkle removing rollers 46 and 47 according to the embodiment can apply a tension in the direction which intersects the transport direction A while the recording medium M is being transported, and thereby the formation of wrinkles can be prevented in mounting the recording medium M on the adhesive belt 2 while wrinkles already formed on the recording medium M can be reduced on the transport path before the recording medium M is supplied onto the adhesive belt 2. The structure which "can apply a tension in the direction which intersects the transport direction A" includes any structure capable of applying a tension (force for pulling the recording medium M outward) in the direction which intersects the transport direction A (capable of smoothing wrinkles in the direction which intersects the transport direction A) by using at least one of the contact surfaces. This is because, depending on the type of recording medium M, in some cases, it is not necessary to apply a tension in the direction which intersects the transport direction A, or in some cases, another negative effect may occur by applying the tension in the direction which intersects the transport direction A. In order not to apply a tension in the direction which intersects the transport direction A, in this embodiment, for example, the smooth surface 46*d* (the smooth surface of the wrinkle removing roller 47) of the wrinkle removing roller 46 can be pressed against the recording medium M with a weak force. Furthermore, the structure for applying a tension may be, for example, any structure that can directly apply a force to the recording medium M in the direction which intersects the transport direction A (for example, in this embodiment, the structure for pressing one of the surface 46*a*, the surface 46*b*, and the surface 46*c* of the wrinkle removing roller 46, on which the grooves that extend outward toward the downstream side in the transport direction A are formed, against the recording medium M). Furthermore, for example, a structure for indirectly applying a force to the recording medium M in the direction which intersects the transport direction A by applying a force in a direction which does not intersect the transport direction A (for example, in this embodiment, the structure for pressing the smooth surface 46*d* of the wrinkle removing roller 46 (the smooth surface of the wrinkle removing roller 47) against the recording medium M with a strong force) may be employed.

The tension applying unit 52 according to the embodiment includes the surface 46*a*, the surface 46*b*, the surface 46*c*, the surface 46*d*, and the like that have different surface characteristics, as the contact surface to come into contact with the recording medium M. As described above, because a plurality of components corresponding to the surface 46*a*, the surface 46*b*, the surface 46*c*, and the surface 46*d* are not provided (these surfaces are provided on a single wrinkle removing roller 46), while the increase in the number of components can be prevented, the formation of wrinkles in the recording medium M can be reduced.

In other words, the tension applying unit 52 according to the embodiment includes, as the tension applying section, the wrinkle removing roller 46 (wrinkle removing roller 47) that has the surfaces of different surface characteristics thereon. Accordingly, this simple structure enables to reduce the increase in the number of components and the formation of wrinkles in the recording medium M. The wrinkle removing rollers 46 and 47 according to the embodiment have circular cross sections, however, the shapes of the cross sections are not limited to the circular shapes. Alternatively, the cross sections may be an elliptical shape or a polygonal shape.

The tension applying unit 52 according to the embodiment includes the wrinkle removing roller 46 and the wrinkle removing roller 47, and consequently, the tension applying unit 52 has the plurality of surfaces having different contact areas as the contact areas that come into contact with the recording medium M. Accordingly, the contact areas can be changed to reduce the formation of wrinkles in the recording medium M. Furthermore, the plurality of surfaces having different contact areas can simplify the respective structures of the surfaces.

In other words, the tension applying unit 52 according to the embodiment has the plurality of rollers of different outer diameters. Accordingly, the formation of wrinkles in the recording medium M can be specifically effectively reduced. Alternatively, the number of the surface types of the wrinkle removing roller 46 and the wrinkle removing roller 47 may be smaller (for example, one type) respectively, and these rollers having respective simple structures can reduce the formation of wrinkles in the recording medium M.

Furthermore, the feeding section 40 can apply a predetermined tension (tension appropriate for the type of recording medium M) to the recording medium M in the transport direction A between the tension applying unit 52 and the adhesive belt 2 in the transport direction A by adjusting the angle of the rotating plate 53 to the base section 57, and consequently, the feeding section 40 according to the embodiment can also serve as a tension adjusting mechanism for adjusting the tension in the recording medium M in the transport direction A. The recording apparatus 1 according to the embodiment having such a structure can support the recording medium M by the adhesive belt 2 with the predetermined tension applied in the transport direction A. Accordingly, the formation of wrinkles in the recording medium M can be specifically effectively reduced.

Furthermore, the recording apparatus 1 according to the embodiment includes the setting section 41 for supplying the recording medium M onto the adhesive belt 2, and the tension applying unit 52 is disposed between the setting section 41 and the adhesive belt 2 (on the upstream side of the transport section in the transport direction A). Accordingly, the formation of wrinkles during the supply of the recording medium M from the setting section 41 to the adhesive belt 2 can be effectively reduced.

Specifically, the recording apparatus 1 according to the embodiment includes the pressure roller 51 that serves as a pressing section that presses the recording medium M supplied from the setting section 41 against the adhesive belt 2. The tension applying unit 52 is disposed between the setting section 41 and the pressure roller 51 in the transport direction A. Accordingly, the recording apparatus 1 can appropriately support the recording medium M on the adhesive belt 2, and the formation of wrinkles during the supply of the recording medium M from the setting section 41 to the adhesive belt 2 can be effectively reduced.

Alternatively, a winding section for winding a medium (recording medium M) transported by the transport section such as the adhesive belt 2 may be provided, and between the transport section and the winding section, the tension applying section may be provided. The recording apparatus 1 having such a structure can effectively reduce the formation of wrinkles in the medium during the winding operation by the winding section. It should be noted that in addition to the tension applying section provided between the transport section and the winding section (on the downstream side of the transport section in the transport direction A), it is preferable that the tension applying section be provided on the upstream side of the transport section in the transport direction A, and thereby the formation of wrinkles during the supply of the medium to the transport section can be effectively reduced.

The wrinkle removing rollers 46 and 47 according to the embodiment have metallic members respectively. In other words, the tension applying unit 52 according to the embodiment includes the metallic members. Accordingly, the buildup of static electricity on the recording medium M can be released through the tension applying unit 52.

Furthermore, the tension applying section may include a resin member. The resin member can reduce the weight of the tension applying section, and facilitate the replacement of the tension applying sections when the tension applying section deteriorates.

It is to be understood that the present invention is not limited to the above-described embodiment, various modifications can be made within the scope of the following claims, and these modifications are included within the scope of the invention.

This application claims priority under 35 U.S.C. § 119 to Japanese Patent Application No. 2015-212683, filed Oct. 29, 2015. The entire disclosure of Japanese Patent Application No. 2015-212683 is hereby incorporated herein by reference.

What is claimed is:

1. A medium transport apparatus comprising:

a transport section configured to support a medium and transport the medium in a transport direction; and a wrinkle reducing section comprising at least two surfaces, the at least two surfaces comprising at least a first surface and a second surface, the first surface providing a smooth arc-shaped surface and the second surface providing a plurality of grooves that extend outward towards a downstream side in the transport direction, the wrinkle reducing section configured to come into contact with the medium to reduce a formation of wrinkles in the medium, wherein the wrinkle reducing section can change which of the at least two surfaces comes into contact with the medium.

2. The medium transport apparatus according to claim 1, wherein the wrinkle reducing section includes a roller, the roller comprising the at least two surfaces.

3. The medium transport apparatus according to claim 1, wherein the at least two surfaces each have a different surface area capable of contacting the medium.

4. The medium transport apparatus according to claim 3, wherein the wrinkle reducing section includes a plurality of rollers of different outer diameters.

5. The medium transport apparatus according to claim 1, further comprising:

a tension adjusting mechanism provided between the wrinkle reducing section and the transport section, the tension adjusting mechanism being capable of applying a predetermined tension to the medium in the transport direction.

6. The medium transport apparatus according to claim 1, further comprising:

a supplying section configured to supply the medium to the transport section, wherein the wrinkle reducing section is provided between the supplying section and the transport section.

7. The medium transport apparatus according to claim 6, further comprising:

a pressing section configured to press the medium supplied from the supplying section against the transport section, wherein the wrinkle reducing section is provided between the supplying section and the pressing section.

8. The medium transport apparatus according to claim 1, further comprising:

a winding section configured to wind the medium transported by the transport section, wherein the wrinkle reducing section is provided between the transport section and the winding section.

9. The medium transport apparatus according to claim 1, wherein the wrinkle reducing section includes a metallic member.

10. The medium transport apparatus according to claim 1, wherein the wrinkle reducing section includes a resin member.

* * * * *